US008404624B2

(12) United States Patent
Ribeaud

(10) Patent No.: US 8,404,624 B2
(45) Date of Patent: Mar. 26, 2013

(54) ANTIWEAR LUBRICANT COMPOSITIONS FOR USE IN COMBUSTION ENGINES

(75) Inventor: Marc Ribeaud, Delémont (CH)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 481 days.

(21) Appl. No.: 11/886,701

(22) PCT Filed: Mar. 13, 2006

(86) PCT No.: PCT/EP2006/060644

§ 371 (c)(1), (2), (4) Date: Sep. 19, 2007

(87) PCT Pub. No.: WO2006/100188

PCT Pub. Date: Sep. 28, 2006

(65) Prior Publication Data

US 2008/0312115 A1 Dec. 18, 2008

(30) Foreign Application Priority Data

Mar. 21, 2005 (EP) ..... 05102226

(51) Int. Cl.

| | |
|---|---|
| ***C10M 135/36*** | (2006.01) |
| ***C10M 137/08*** | (2006.01) |
| ***C10M 133/44*** | (2006.01) |
| ***C10M 133/46*** | (2006.01) |

(52) U.S. Cl. ..... 508/272; 508/436; 508/279; 508/284

(58) Field of Classification Search ..... 252/586; 428/336; 508/273, 272, 436, 279, 284; 524/241
See application file for complete search history.

(56) References Cited

U.S. PATENT DOCUMENTS

| | | | | |
|---|---|---|---|---|
| 4,431,552 | A | 2/1984 | Salentine | 252/32.7 |
| 4,904,403 | A | 2/1990 | Karol | 252/47.5 |
| 5,492,954 | A * | 2/1996 | Babiarz et al. | 524/241 |
| 5,892,051 | A | 4/1999 | Wirth et al. | |
| 6,531,429 | B2 | 3/2003 | Fletschinger et al. | |
| 6,756,346 | B1 | 6/2004 | Baba et al. | |
| 7,026,273 | B2 | 4/2006 | Robson et al. | |
| 2002/0160180 | A1 * | 10/2002 | Yamamoto et al. | 428/336 |
| 2003/0158051 | A1 * | 8/2003 | Karol et al. | 508/273 |
| 2005/0263745 | A1 * | 12/2005 | Momoda et al. | 252/586 |

FOREIGN PATENT DOCUMENTS

| | | | |
|---|---|---|---|
| CA | 2013545 | | 10/1990 |
| EP | 0166696 | | 1/1986 |
| EP | 0406517 | A2 | 1/1991 |
| EP | 1526170 | | 4/2005 |
| JP | 61031494 | A | 2/1986 |
| JP | 3047897 | A | 2/1991 |
| JP | 11217577 | A | 8/1999 |
| JP | 2000063866 | A | 2/2000 |
| JP | 2001-049280 | | 2/2001 |
| JP | 2003155495 | A | 5/2003 |

OTHER PUBLICATIONS

English Language Abstract for EP 0166696, Jan. 2, 1986.
English language abstract not available for JP 3047897; however, see English language equivalent CA 2013545. Original document extracted from the espacenet.com database on Apr. 25, 2012, 53 pages.
English language abstract not available for JP 61031494; however, see English language equivalent US 5,892,051. Original document extracted from the espacenet.com database on Apr. 25, 2012, 25 pages.
English language abstract for JP 2000063866 extracted from the espacenet.com database on Apr. 25, 2012, 20 pages.
English language abstract and translation for JP 2001-049280 extracted from the PAJ database on Apr. 25, 2012, 39 pages.
English language abstract for JP 2003155495 extracted from the espacenet.com database on Apr. 25, 2012, 14 pages.
English language abstract for JP 11217577 extracted from the espacenet.com database on Apr. 25, 2012, 21 pages.

* cited by examiner

*Primary Examiner* — Ellen McAvoy
*Assistant Examiner* — Chantel Graham
(74) *Attorney, Agent, or Firm* — Howard & Howard Attorneys PLLC

(57) ABSTRACT

The invention relates to an additive composition, which comprises an additive mixture that essentially consists of a) At least one ammonium phosphate ester; b) At least one thiophosphoric acid ester, and c) At least one dithiophosphoric acid derivative; in combination with sulphur containing oil additives; and a process for the reduction of wear in combustion engines, such as spark ignition or Diesel motor engines.

22 Claims, No Drawings

ANTIWEAR LUBRICANT COMPOSITIONS FOR USE IN COMBUSTION ENGINES

The present invention relates to a lubricant composition for use in combustion engines, an additive composition, which comprises an additive mixture that essentially consists of a) At least one ammonium phosphate ester;

b) At least one triphosphoric acid ester; and c) At least one dithiophosphoric acid derivative.

This mixture is combined with sulphur containing oil additives. The invention also relates to a process for the reduction of wear in combustion engines.

It is known that additives improve the performance properties of lubricants, such as mineral oils or synthetic or semi-synthetic oils. Particularly additives are highly desirable which reduce the formation of oxidative degradation products and promote a long shelf life and high performance stability of lubricants.

Zinc dialky-/diaryldithiophosphates (ZnDTP)

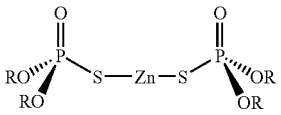

are additives of first choice. Beside excellent antiwear and extreme pressure properties ZnDTP's are also efficient antioxidants and even metal passivators. These multifunctional properties make them the widest spread cost effective additive group that is used nowadays in huge quantities in engine oils, shock absorber oils and hydraulic fluids, cf. *Ullmann's Encyclopaedia of Industrial Chemistry*, Lubricants and Lubrication, Wiley-VCH Vertag, DPI: 10.1002/14356007.a15_423, Article Online Posting Date: Jan. 15, 2002, and C. G. A. Von Eberan-Eberhorst, R. S. Hexter, A. C. Clark, B. O'Connor, R. H. Walsh, Aschegebende Extreme-Pressure- und Verschlelβschutz-Additive, in: W. J. Bartz (ed.): *Additive für Schmisrstoffe*, Expert Verlag, 1994, pp. 53-83.

Various regulations issued by environmental government agencies in the European Community (EC), the U.S. and other countries require strict limitations with regard to the composition of exhaust fumes emitted from combustion motor engines that operate with self-ignition (Diesel motor engines) or spark Ignition (Otto motor engines). In view of the fact that these exhaust fumes at present do not fulfil the environmental regulations, exhaust fume after treatment devices are installed.

These devices consist of porous membranes (particulate traps) or porous supports for catalysts, which deteriorate by the deposition of undesirable by-products in the form of ash particles produced by the combustion process. The activity of solid catalysts is particularly reduced by the interaction with solid phosphorus compounds as well as acidic sulphur compounds. These by-products, generally classified as ash, partially result from the presence of lubricant additives present in motor fuels and oils.

In order to minimize the negative impact of the lubricant additives, so-called low SAPS (Sulfated Ash, Phosphorus and Sulfur) engine oils are developed, e.g. Shigekl Takeshima, Nippon Corp., Development and durability of low SAPS diesel engine oils for passenger cars (JSAE Paper No. 20045277).

There is a tendency that the amount of ash producing detergents, phosphorus additives and ZnDTP is reduced in recently developed lubricant compositions. This invention therefore has for its object to provide substantially metal-free additives or additive combinations of low sulphur and phosphorus content, which approach the good antioxidative and wear protection of the zinc dialkyldithiophosphates used to date.

U.S. Pat. Specification No. 5,531,911 describes zinc-free hydraulic fluids that comprise phosphorus- and sulphur-containing additive components. One component is a thiophosphoric acid ester of the triphenylthiophosphate type (IRGALUBE TPPT). This is combined with dithiophosphoric acid esters of the IRGALUBE 63 type and with other optional oil additive components, for example ammonium sulphonates.

WO 02/053687 discloses a lubricating oil composition comprising β-dithiophosphorylated propionic acid (A), 3-(O, O-diisopropyldithiophosphoryl)-2-methylpropionic acid, triaryl(Irgalube®353), triaryl phosphate (B) and base oil comprising mineral oil and/or synthetic oil, EP-A-903 399 discloses hydraulic fluid compositions comprising thiophosphoric acid esters and dithiophosphoric acid esters or phosphoric acid thio esters and oil additives from the group of the polyol partial esters, amines and epoxides.

It has surprisingly been found that an additive mixture that essentially consists of a) At least one ammonium phosphate ester;

b) At least one thiophosphotic acid ester; and c) At least one dithiophosphoric acid derivative, in combination with additional sulphur containing oil additives;

is particularly useful for preparing a lubricant composition that has a low metal content and meets the requirements of low sulphur and phosphorus content.

The present invention relates to a lubricant composition for use in combustion engines comprising A) An additive mixture that essentially consists of a) At least one ammonium phosphate ester;

b) At least one thiophosphoric acid ester; and c) At least one dithiophosphoric acid derivative;

B) At least one additional sulphur containing oil additive;

C) Customary crank case oil additives; and

D) Low sulphur oil of lubricating viscosity;

With the proviso that the total amount of sulphur in the composition is less than 0.3 weight %.

The compositions containing the additive mixture as specified above are characterized by their superior performance as compared with the corresponding compositions containing ZNDTP. This can be demonstrated In various commonly accepted tests, such as C&T PVW 5106 (developed by VW (VAG)) and Pressurized Differential Scanning Calorimetry (PDSC).

The compositions according to the instant invention are particularly suitable for use as lubricants having excellent antioxidative properties in internal combustion engines, such as spark-ignition internal combustion engines (popularly known as Otto motor engines) or self-ignition internal combustion engines (popularly known as Diesel motor engines).

The compositions are particularly suitable as motor oils which meet the classifications of the API (American Petroleum Institute: 1120L Str. NW, Washington D.C., USA), the S- and C-categories (e.g. SM, CE, as described in ASTM D 4485), the GF-categories defined by ILSAC (International Lubricant Standardization and Approval Committee, published by API) and to the A, B, C and E specifications issued by ACEA (European Automobile Manufacturers Association, Rue du Noyer 211, B-1000 Bruxelles BE).

A preferred embodiment of the invention relates to a lubricant composition, wherein the additive mixture A) essentially consists of a) At least one ammonium phosphate ester of the formula

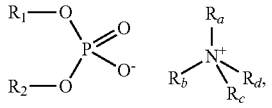

(I)

Wherein one of $R_2$, and $R_2$ represents hydrogen and the other one represents a $C_1$-$C_{20}$hydrocarbon radical; or Both $R_1$ and $R_2$ represent $C_1$-$C_{20}$hydrocarbon radicals; and $R_a$, $R_b$, $R_c$ and $R_d$ independently of one another represent hydrogen or $C_6$-$C_{20}$hydrocarbon radicals;

b) At least one thiophosphoric acid ester of the formula

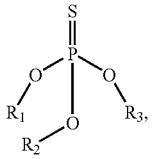

(II)

Wherein $R_1$, $R_2$ and $R_3$ represent $C_3$-$C_{20}$hydrocarbon radicals; and c) At least one dithiophosphoric acid derivative selected from the group consisting of a 3-dithiophosphorylpropionic acid of the formula

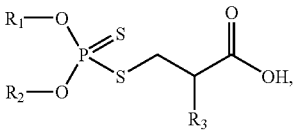

(III)

Wherein $R_1$ and $R_2$ Independently of one another represent $C_3$-$C_{18}$alkyl, $C_5$-$C_{12}$cycloalkyl, $C_9$-$C_{10}$bicycloalkylmethyl, $C_9$-$C_{10}$tricycloalkylmethyl, phenyl or $C_7$-$C_{24}$alkylphenyl; or $R_1$ and $R_2$ together represent the group:

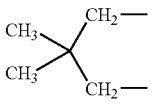

; and $R_3$ represents hydrogen or methyl,

And an ammonium salt of a dithiophosphoric acid of the formula

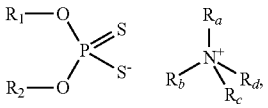

(IV)

Wherein $R_1$ and $R_2$ are as defined with regard to the formula (III) and $R_a$, $R_b$, $R_c$ and $R_d$ independently of one another represent hydrogen or $C_6$-$C_{20}$hydrocarbon radicals.

A particularly preferred embodiment of the invention relates to a lubricant composition, wherein the additive mixture A) consists essentially of a) At least one ammonium phosphate ester (I), wherein one of $R_1$ and $R_2$ represents hydrogen and the other one represents $C_3$-$C_{18}$alkyl; or both $R_1$ and $R_2$ represent $C_3$-$C_{18}$alkyl; and $R_a$, $R_b$, $R_c$ and $R_d$ independently of one another represent hydrogen or $C_6$-$C_{20}$alkyl;

b) At least one thiophosphoric acid ester (II), wherein $R_1$, $R_2$ and $R_3$ independently of one another represent phenyl or $C_7$-$C_{24}$alkylphenyl; and c) At least one dithiophosphoric acid derivative selected from the group consisting of a 3-dithiophosphorylpropionic acid (III), wherein $R_1$ and $R_2$ represent $C_3$-$C_{18}$alkyl and $R_3$ represents hydrogen or methyl, and an ammonium salt of a dithiophosphoric acid (IV), wherein $R_1$ and $R_2$ represent $C_3$-$C_{18}$alkyl and $R_a$, $R_b$, $R_c$ and $R_d$ independently of one another represent hydrogen or $C_6$-$C_{20}$alkyl.

A highly preferred embodiment of the invention relates to a lubricant composition, wherein the additive mixture A) consists essentially of a) At least one ammonium phosphate ester (I), wherein one of $R_1$ and $R_2$ represents hydrogen and the other one represents $C_3$-$C_9$alkyl; or both $R_1$ and $R_2$ represent $C_3$-$C_9$alkyl; and $R_a$, $R_b$, $R_c$ and $R_d$ independently of one another represent hydrogen or $C_12$-$C_{20}$alkyl;

b) At least one thiophosphoric acid ester (II), wherein $R_1$, $R_2$ and $R_3$ independently of one another represent phenyl or $(C_1$-$C_9$alkyl$)_{1-3}$phenyl; and c) At least one dithiophosphoric acid derivative selected from the group consisting of a 3-dithiophosphorylpropionic acid (III), wherein $R_1$ and $R_2$ represent 2-methylpropyl and $R_3$ represents methyl, and an ammonium salt of a dithiophosphoric acid (IV), wherein $R_1$ and $R_2$ represent isopropyl and $R_a$, $R_b$, $R_c$ and $R_d$ independently of one another represent hydrogen or $C_{12}$-$C_{20}$alkyl.

A highly preferred embodiment of the invention relates to a lubricant composition, wherein the additive mixture A) consists essentially of a) At least one ammonium phosphate ester (I), wherein one of $R_1$ and $R_2$ represents hydrogen and the other one represents $C_3$-$C_9$alkyl; or both $R_1$ and $R_2$ represent represents $C_3$-$C_9$alkyl; and $R_a$, $R_b$, $R_c$ and $R_d$ independently of one another represent hydrogen or $C_{12}$-$C_{20}$alkyl:

b) At least one thiophosphoric acid ester (II), wherein $R_1$, $R_2$ and $R_3$ represent phenyl; or one of $R_1$, $R_2$ and $R_3$ represents phenyl and two of $R_1$, $R_2$ and $R_3$ represent $(C_1$-$C_9$alkyl$)_{1-3}$phenyl; or two of $R_1$, $R_2$ and $R_3$ represent phenyl and one of $R_1$, $R_2$ and $R_3$ represents $(C_1$-$C_9$alkyl$)_{1-3}$phenyl; or $R_1$, $R_2$ and $R_3$ represent $(C_1$-$C_9$alkyl$)_{1-3}$phenyl; and c) At least one 3-dithiophosphorylpropionic acid (III), wherein $R_1$ and $R_2$ represent 2-methylpropyl and $R_3$ represents methyl.

Component A

The additive mixture present in the Component A) consists of at least three different phosphate, thiophosphate or dithiophosphate additives.

The phosphate component a) of that mixture is an ammonium phosphate ester, such as the one represented by the formula (I) of above, wherein one of $R_1$ and $R_2$ represents hydrogen and the other one represents a $C_1$-$C_{20}$hydrocarbon radical; or both $R_1$ and $R_2$ represent $C_1$-$C_{20}$hydrocarbon radicals; and $R_a$, $R_b$, $R_c$ and $R_d$ independently of one another represent hydrogen or $C_6$-$C_{20}$hydrocarbon radicals.

According to a preferred embodiment one of $R_1$ and $R_2$ represents hydrogen and the other one represents $C_3$-$C_{18}$alkyl; or both $R_1$ and $R_2$ represent $C_3$-$C_{18}$alkyl; and $R_a$, $R_b$, $R_c$ and $R_d$ independently of one another represent hydrogen or $C_5$-$C_{20}$alkyl.

According to a particularly preferred embodiment one of $R_1$ and $R_2$ represents hydrogen and the other one represents $C_3$-$C_{18}$alkyl; or both $R_1$ and $R_2$ represent $C_3$-$C_{18}$alkyl; and $R_a$, $R_b$, $R_c$ and $R_d$ independently of one another represent hydrogen or $C_{12}$-$C_{20}$alkyl.

A $C_1$-$C_{20}$hydrocarbon radical $R_1$ and $R_2$ is preferably $C_1$-$C_{20}$alkyl, e.g. methyl, ethyl or straight chained or branched $C_3$-$C_{20}$alkyl, e.g. n-propyl, isopropyl, n-, iso- or tert-butyl, n-pentyl, isoamyl, neopentyl, 2-ethylbutyl, n-hexyl, 1-methylpentyl, 1,3-dimethylbutyl, n-heptyl, isoheptyl, n-octyl, 1,4,4-trimethyl 2-pentyl, 3,4-, 3,5- or 4,5-dimethyl-1-hexyl, 3- or 5-methyl-1-heptyl, 1,1,3,3-tetramethylbutyl, 2-ethylhexyl, branched octyl as obtained from a dimer of isobutylene, n-nonyl, 1,1,3-trimethylhexyl, branched nonyl as obtained from a trimer of tripropylene, 1-methylundecyl, 2-n-butyl-n-octyl, branched dodecyl obtained from a trimer of isobutylene or a tetramer of propylene, branched pentadecyl obtained from a pentamer of propylene, 2-n-hexyl-n-decyl or 2-n-octyl-n-dodecyl.

$R_a$, $R_b$, $R_c$ and $R_d$ defined as $C_6$-$C_{20}$alkyl have the same meanings as $R_1$ and $R_2$ defined above with regard to alkyl groups of 6-20 carbon atoms.

Ammonium phosphate esters as represented by the formula (I) are known compounds and can be prepared by known methods. Many of them are commercially available, such as the product Irgalube® (trade mark of Ciba Specialty Chemicals AG) 349:

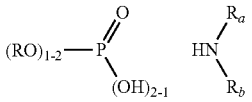

Wherein R represents $C_3$-$C_{18}$alkyl and $R_a$ and $R_b$ represent $C_6$-$C_{20}$alkyl, such as products named as amines, C11-14-branched alkyl, monohexyl and dihexyl phosphates.

Other ammonium phosphate esters present in the composition according to the invention are available commercially by Rheinchemie Rheinau GmbH Mannheim Germany, such as the products Additin® RC 3740, RC 3741 or RC 3760 (amine neutralized phosphoric acid ester of aliphatic alcohols).

The thiophosphate component b) of the additive mixture is a thiophosphoric acid ester, such as the one of the formula (II) of above, wherein $R_1$, $R_2$ and $R_3$ represent $C_3$-$C_{20}$hydrocarbon radicals.

According to a preferred embodiment $R_1$, $R_2$ and $R_3$ independently of one another represent phenyl or $C_7$-$C_{20}$alkylphenyl.

According to a particularly preferred embodiment, $R_1$, $R_2$ and $R_3$ independently of one another represent phenyl or $(C_1$-$C_9$alkyl$)_{1-3}$phenyl.

According to a highly preferred embodiment, $R_1$, $R_2$ and $R_3$ independently of one another represent $R_1$, $R_2$ and $R_3$ represent phenyl; or one of $R_1$, $R_2$ and $R_3$ represents phenyl and two of $R_1$, $R_2$ and $R_3$ represent $(C_1$-$C_9$alkyl$)_{1-3}$phenyl; or two of $R_1$, $R_2$ and $R_3$ represent phenyl and one of $R_1$, $R_2$ and $R_3$ represents $(C_1$-$C_9$alkyl$)_{1-3}$phenyl; or $R_1$, $R_2$ and $R_3$ represent $(C_1$-$C_9$alkyl$)_{1-3}$phenyl.

$C_3$-$C_{20}$Hydrocarbon radicals $R_1$, $R_2$ and $R_3$ are preferably $C_3$-$C_{20}$alkyl, $C_5$-$C_{12}$cycloalkyl, $C_5$-$C_{12}$cycloalkyl-$C_1$-$C_4$alkyl, phenyl, $C_7$-$C_{20}$alkylphenyl, $C_7$-$C_{20}$alkoxyphenyl, naphthyl and $C_7$-$C_9$phenylalkyl.

$C_3$-$C_{20}$Alkyl is, e.g., n-nonyl, 1,1,3-trimethylhexyl, n-decyl, n-undecyl, n-dodecyl. 1-methylundecyl, n-tridecyl, n-tetradecyl, n-pentadecyl, n-hexadecyl, n-neptadecyl and n-octadecyl. An especially preferred radical for $R_1$, $R_2$ and $R_3$ is isopropyl. The meanings of $R_1$, $R_2$ and $R_3$ may be the same or different.

Triphosphoric acid esters of formula II are known, for example from U.S. Pat. No. 5,531,911. Many of them are commercially available.

$C_5$-$C_{12}$Cycloalkyl is, e.g., cyclopentyl or cyclohexyl. $C_5$-$C_{12}$Cycloalkyl-$C_1$-$C_4$alkyl is, e.g. cyclopentylmethyl, 2-cyclopentylethyl, cyclohexylmethyl or 2-cyclohexylethyl.

$C_7$-$C_{20}$Alkylphenyl is phenyl that is substituted, for example, by from one to three of the $C_1$-$C_4$alkyl radicals described above or by one or two $C_1$-$C_6$alkyl radicals or one $C_1$-$C_{12}$alkyl radical.

$C_7$-$C_{2)}$Alkoxyphenyl is phenyl that is substituted, for example, by from one to three $C_1$-$C_4$-alkoxy radicals, especially methoxy or ethoxy, or by one or two $C_1$-$C_6$alkoxy radicals or one $C_1$-$C_{12}$alkoxy radical, those radicals being analogous to the alkyl radicals mentioned hereinabove.

$C_7$-$C_9$Phenylalkyl is, e.g. benzyl, 1-phenyl-1-ethyl or 2-phenyl-1-ethyl.

In a preferred embodiment of the invention, component b) consists of a mixture of thiophosphoric acid esters of formula:

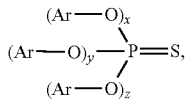

(II')

wherein x is from 0 to 2.7, y is 3−(x+z), z is from 0 to 3−(x+y) and x+y+z=3, and Ar is phenyl, $C_7$-$C_{18}$alkylphenyl, $C_7$-$C_{18}$alkoxyphenyl, naphthyl or $C_7$-$C_9$phenylalkyl as defined above. The preparation of those triphosphoric acid esters Is described in EP-A-368 803. Preferred triphosphoric acid esters of formula I' are triarylthiophosphate mixtures of the IRGALUBE 211 type comprising substances, such as n-decylphenyl-n-nonylphenyl-phenylthiophosphate, o-tert-butylphenyl-o-isopropylphenyl-phenylthiophosphate, or n-hexylphenyl-phenylthiophosphate mixtures.

In a further preferred embodiment of the invention, component b) consists of a triphosphoric acid ester of the triphenylthiophosphate type (IRGALUBE TPPT), such as O,O,O-tris(2(or 4)-C9-10-isoalkylphenyl)phosphorothioate.

The dithiophosphate component c) of the additive mixture is a dithiophosphoric acid derivative, such as the one of the formula (III) or (IV). In a compound (III) $R_1$ and $R_2$ independently of one another represent $C_3$-$C_{18}$alkyl, $C_9$-$C_{10}$cycloalkyl, $C_9$-$C_{10}$bicycloalkylmethyl, $C_9$-$C_{10}$tricycloalkylmethyl, phenyl or $C_7$-$C_{24}$alkylphenyl; or $R_1$ and $R_2$ together represent the group:

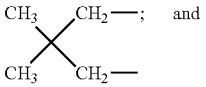

$R_3$ represents hydrogen or methyl, preferably hydrogen.

$R_1$ and $R_2$ defined as $C_3$-$C_{18}$alkyl are, with preference, isopropyl, isobutyl or 2-ethylhexyl. Other groups include n-propyl, n- or tert-butyl, n-pentyl, isoamyl, neopentyl, 2-ethylbutyl, n-hexyl, 1-methylpentyl, 1,3-dimethylbutyl, n-heptyl, isoheptyl, n-octyl, 1,4,4-trimethyl-2-pentyl, 3,4-, 3,5- or 4,5-dimethyl-1-hexyl, 3- or 5-methyl-heptyl, 1,1,3,3-tetramethylbutyl, branched octyl as obtained from a dimer of isobutylene, n-nonyl, 1,1,3-trimethylhexyl, branched nonyl as obtained from a trimer of tripropylene.

The groups $C_6$-$C_{12}$cycloalkyl, $C_9$-$C_{10}$bicycloalkylmethyl, $C_9$-$C_{10}$tricycloalkylmethyl, $C_7$-$C_{24}$alkylphenyl are the ones as specified in U.S. Patent Specification No. 5,922,657.

Compounds (III) are known, e.g. from U.S. Pat. No. 5,922,657.

In ammonium salt of a dithiophosphoric acid of the formula (IV) $R_1$ and $R_2$ are as defined with regard to the formula (III) and $R_a$, $R_b$, $R_c$ and $R_d$ independently of one another represent hydrogen or $C_6$-$C_{20}$hydrocarbon radicals. $R_a$, $R_b$, $R_c$ and $R_a$ defined as $C_6$-$C_{20}$alkyl have the same meanings as $R_a$, $R_b$, $R_c$ and $R_d$ defined above with regard to the ammonium phosphates (I) and the alkyl groups of 6-20 carbon atoms.

A particularly preferred embodiment relates to the ammonium salt of a dithiophosphoric acid of the formula:

(XPDL 613)

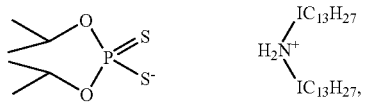

such as O,O-diisopropyl hydrogen dithiophosphate alkyl amine.

According to a particularly preferred embodiment, the dithiophosphoric add derivative is selected from the group consisting of a 3-dithiophosphorylpropionic acid (III), wherein $R_1$ and $R_2$ represent $C_3$-$C_{18}$alkyl and $R_3$ represents hydrogen or methyl, and an ammonium salt of a dithiophosphoric acid (IV), wherein $R_1$ and $R_2$ represent $C_3$-$C_{18}$alkyl and $R_a$, $R_b$, $R_c$ and $R_d$ independently of one another represent hydrogen or $C_6$-$C_{20}$alkyl.

According to a highly preferred embodiment, the dithiophosphoric acid derivative is selected from the group consisting of a 3-dithiophosphorylpropionic acid (III), wherein $R_1$ and $R_2$ represent $C_3$-$C_{18}$alkyl and $R_3$ represents hydrogen or methyl, and an ammonium salt of a dithiophosphoric acid (IV), wherein $R_1$ and $R_2$ represent $C_3$-$C_{18}$alkyl and $R_a$, $R_b$, $R_c$ and $R_d$ independently of one another represent hydrogen or $C_9$-$C_{20}$alkyl.

A highly preferred embodiment relates to 3-dithiophosphoryl-2-methylpropionic acid (III), such as 3-[[bis(2-methylpropoxy)phosphinothioyl]thio]-2-methylpropanoic acid:

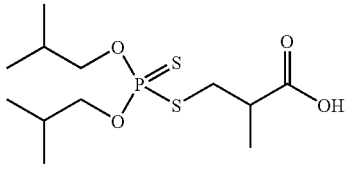

This compound is commercially available and marketed under the trademark IRGALUBE 353.

In a preferred embodiment of the invention, the phosphorus content of components a), b) and c) in the additive mixture defined, based on the composition is less than 800 ppm. In an especially preferred embodiment, the phosphorus content is from 400 to 800 ppm, especially from 300 to 700 ppm. The ratio by weight of component b) to component c) may vary within the ranges of approximately from 10:10:80 and 80:10:10 to 10:80:10% by weight.

Although the total content of the Component A) in the composition is not critical, the preferred total content of component A) in the composition is in the range between 1.0 and 0.001, preferably 0.1 and 0.01 percent by weight, based on the total weight of the composition, or, preferably, between 0.01 and 0.1%, as expressed by the total phosphorus content in the composition.

Component B

The lubricant composition according to the invention, which is suitable for use in combustion engines comprises the Component A) defined above, wherein an additive mixture is present that essentially consists of a) At least one ammonium phosphate ester;

b) At least one thiophosphoric acid ester and c) At least one dithiophosphoric acid derivative.

This additive mixture is combined with at least one additional sulphur containing oil additive. Various sulphur containing oil additives are suitable. Preferred is a dithioglycidyl ether selected from the group consisting of

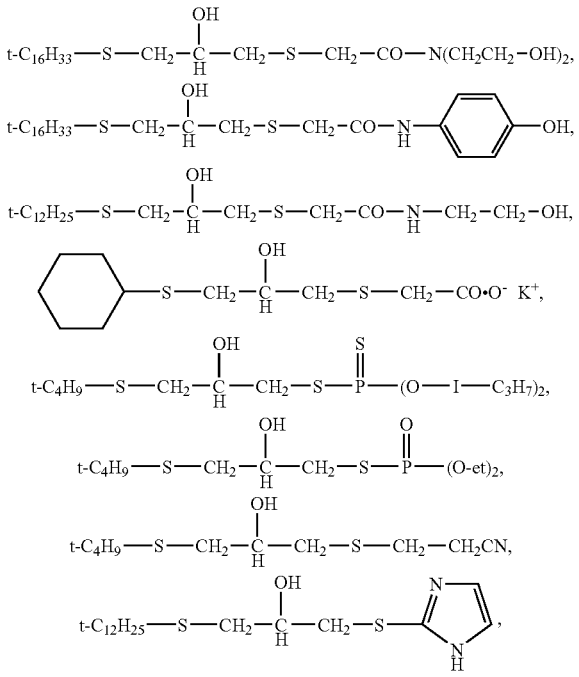

-continued

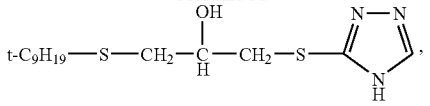

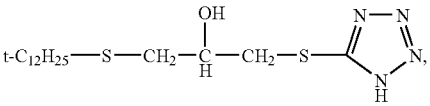

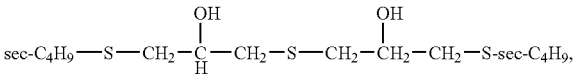

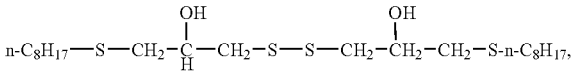

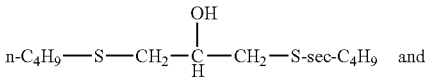

and

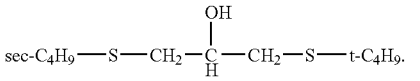

These compounds are known. Their preparation is described in the published European Patent Application No. 0 166 696. According to another embodiment the additional sulphur containing oil additive B) is a polyalkylated 1,3,4-thiadiazole compound of the formula

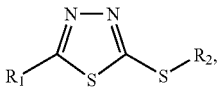

Wherein $R_1$ represents hydroxy, amino, mercapto, alkylthio, 2-hydroxyalkylthio or the $R_2$—S group and $R_2$ represents a polyolefin residue represented by the partial formulae:

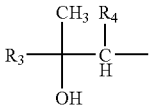

or isomeric

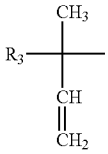

and

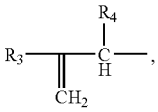

wherein $R_3$ represents alkyl having 50 to 400 carbon atoms and $R_4$ represents hydrogen or methyl.

The polyalkylated 1,3,4-thiadiazole compounds described above are known compounds. Their preparation is described in the published European Patent Application No. 0 406 517.

A particularly preferred compound is. C9-alkyldithiothiadiazole, which is commercially available marketed under the trademark Hitec® 4313.

Environmental regulations issued by various government agencies prescribe that the total amount of sulphur in the composition Is less than 0.3%, preferably 0.2% by weight. The additive combination described above is added to the fuel that a content of less than 0.10%, preferably less than 0.05% and particularly less than 0.01%, by weight of sulphur is present.

Component C

The composition according to the invention comprises at least one additional customary oil additive in addition to the components A) and B). Such additives include: further antioxidants, metal passivators, rust inhibitors, viscosity index enhancers, pour-point depressants, dispersants, detergents, further extreme-pressure additives and anti-wear additives. Such additives are added in the amounts customary for each of them, which range in each case approximately from 0.01 to 10.0%, preferably 0.1 to 1.0%, by weight. Examples of further additives are given below:

1. Phenolic/Aminic Antioxidants:

1.1 Alkylated monophenols: 2,6-di-tert-butyl-4-methylphenol. 2-butyl-4,6-dimethylphenol, 2,6-di-tert-butyl-4-ethylphenol, 2,6-di-tert-butyl-4-n-butylphenol, 2,6-di-tert-butyl-4-isobutylphenol, 2,6-dicyclopentyl-4-methylphenol, 2-(α-methylcyclohexyl)-4,6-dimethylphenol, 2,6-dioctadecyl-4-methylphenol, 2,4,6-tricyclohexylphenol, 2,6-di-tert-butyl-4-methoxymethylphenol, linear nonylphenols or nonylphenols branched in the side chain, such as, for example, 2,6-dinonyl-4-methylphenol, 2,4-dimethyl-6-(1'-methyl-undec-1'-yl)-phenol, 2,4-dimethyl-6-(1'-methylheptadec-1'-yl)-phenol, 2,4-dimethyl-6-(1'-methyltridec-1'-yl)-phenol and mixtures thereof.

1.2 Alkythiomethylphenols; 2,4-dioctylthiomethyl-6-tert-butylphenol, 2,4-dioctylthiomethyl-6-methylphenol, 2,4-dioctylthiomethyl-6-ethylphenol, 2,6-didodecylthiomethyl-4-nonyl-phenol 1.3 Hydroquinones and alkylated hydroquinones: 2,6-di-tert-butyl-4-methoxyphenol, 2,5-ditert-butylhydroquinone, 2,5-di-tert-amylhydroquinone, 2,6-diphenyl-4-octadecyloxyphenol, 2,6-di-tert-butylhydroquinone, 2,5-di-tert-butyl-4-hydroxyanisole, 3,5-di-tert-butyl-4-hydroxyanisole, 3/5-di-tert-butyl-4-hydroxyphenyl stearate, bis(3,5-di-tert-butyl-4-hydroxyphenyl)adipate 1.4 Tocopherols: α-, β-, γ- of δ-tocopherol and mixtures thereof (vitamin E)

1.5 Hydroxylated thiodiphenyl ethers: 2,2'-thio-bis(6-tert-butyl-4-methylphenyl), 2,2'-thiobis(4-octylphenol), 4,4'-thio-bis(6-tertbutyl-3-methylphenol), 4,4'-thio-bis(6-tert-butyl-2-methylphenol), 4,4'-thio-bis(3,6-di-sec-amylphenol), 4,4'-bis(2,6-dimethyl-4-hydroxyphenyl) disulphide 1.6 Alkylidene bisphenols: 2,2'-methylene-bis(6-tert-butyl-4-methylphenol), 2,2'-methylene-bis(6-tert-butyl-4-ethylphenol), 2,2'-methylene-bis[4-methyl-6-(α-methylcyclohexyl)phenol], 2,2'-methylene-bis(4-methyl-6-cyclohexylphenol), 2,2'-methylene-bis(6-nonyl-4-methylphenol), 2,2'-methylene-bis(4,6-di-tert-butylphenol), 2,2'-ethylidene-bis(4,6-di-tert-butylphenol), 2,2'-ethylidene-bis(6-tert-butyl-4-isobutylphenol), 2,2'-methylene-bis[6-(α-methylbenzyl)-4-nonylphenol], 2,2'-methylene-bis[6-(α,α-dimethylbenzyl)-4-nonylphenol], 4,4'-methylene-bis(2,6-di-tert-butylphenol), 4,4'-methylene-bis(6-tert-butyl-2-methylphenol), 1,1-bis(5-tert-butyl-4-hydroxy-2-methylphenyl)butane, 2,6-bis(3-tert-butyl-5-methyl-2-hydroxybenzyl)-4-methylphenol, 1,1,3-tris(5-tert-butyl-4-hydroxy-2-methylphenyl)butane, 1,1-bis(5-tert-butyl-4-hydroxy-2-methylphenyl)-3-n-dodecylmercaptobutane, ethylene glycol bis[3,3-bis(3'-tert-butyl-4'-hydroxyphenyl)butyrate], bis(3-tert-butyl-4-hydroxy-5-methylphenyl)dicyclopentadiene, bis[2-(3'- tert-butyl-2'-hydroxy-5'-methylbenzyl)-6-tert-butyl-4-methylphenyl]terephthalate, 1,1-bis(3,5-dimethyl-2-hydroxyphenyl)butane, 2,2-bis(3,5-di-tert-butyl-4-hydroxyphenyl)propane, 2,2-bis(5-tert-butyl-4-hydroxy-2-methylphenyl)-4-n-dodecylmercaptobutane, 1,1,5,5-tetra(5-tert-butyl-4-hydroxy-2-methylphenyl)pentane 1.7 O-, N- and S-benzyl compounds: 3,5,3',5'-tetra-tert-butyl-4,4'-dihydroxydibenzyl ether, octadecyl-4-hydroxy-3,5-dimethylbenzyl-mercaptoacetate, tridecyl-4-hydroxy-3,5-di-tert-butylbenzyl-mercaptoacetate, tris(3,5-di-tert-butyl-4-hydroxybenzyl)amine, bis(4-tert-butyl-3-hydroxy-2,6-dimethylbenzyl)dithioterephthalate, bis(3,5-di-tert-butyl-4-hydroxybenzyl)sulphide, isooctyl-3,5-di-tert-butyl-4-hydroxybenzyl-mercaptoacetate 1.8 Hydroxybenzylated malonates: dioctadecyl-2,2-bis(3,5-di-tert-butyl-2-hydroxybenzyl)malonate, dioctadecyl-2-(3-tert-butyl-4-hydroxy-5-methylbenzyl)malonate, didodecylmercaptoethyl-2,2-bis(3,5-di-tert-butyl-4-hydroxybenzyl)malonate, di[4-(1,1,3,3-tetramethylbutyl)-phenyl]-2,2-bis(3/5-di-tert-butyl-4-hydroxybenzyl-malonate 1.9 Hydroxybenzyl aromatic compounds: 1,3,5-tris(3,5-di-tert-butyl-4-hydroxybenzyl)-2,4,6-trimethylbenzene, 1,4-bis(3,5-di-tert-butyl-4-hydroxybenzyl)-2,3,5,6-tetramethylbenzene, 2,4,6-tris(3,5-di-tert-butyl-4-hydroxybenzyl) phenol;

1.10 Triazine compounds: 2,4-bis-octylmercapto-6-(3,5-di-tert-butyl-4-hydroxyanilino)-1,3,5-triazine, 2-octylmercapto-4,6-bis(3,5-di-tert-butyl-4-hydroxyanilino)-1,3,5-triazine, 2-octylmercapto-4,6-bis(3,5-di-tert-butyl-4-hydroxyphenoxy)-1,3,5-triazine, 2,4,6-tris(3,5-di-tert-butyl-4-hydroxyphenoxy)-triazine, 1,3,5-tris(3,5-di-tert-butyl-4-hydroxybenzyl)isocyanurate, 1,3,5-tris(4-tert-butyl-3-hydroxy-2,6-dimethylbenyl)isocyanurate, 2,4,6-tris(3,5-di-tert-butyl-4-hydroxyphenylethyl)-1,3,5-triazine, 1,3,5-tris(3,5-di-tert-butyl-4-hydroxyphenylpropionyl)hexahydro-1,3,5-triazine, 1,3,5-tris(3,5-dicyclohexyl-4-hydroxybenzyl)isocyanurate 1.11 Acylaminophenols: 4-hydroxylauric acid anilide, 4-hydroxystearic acid anilide, N-(3,5-di-tert-butyl-4-hydroxyphenyl)-carbamic acid octyl ester 1.12 Esters of β-(3,5-di-tert-butyl-4-hydroxyphenyl)propionic acid: with mono- or polyhydric alcohols, e.g. with methanol, ethanol, n-octanol, isooctanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris (hydroxyethyl)isocyanurate, N,N'-bis(hydroxyethyl) oxalic acid diamide, 3-thiaundecanol, 3-thiapentadecanol, trimethylhexanediol, trimethylolpropane, 4-hydroxymethyl-1-phospha-2,6,7-trioxabicyclo[2.2.2]octane 1.13 Esters of β-(5-tert-butyl-4-hydroxy-3-methylphenyl) propionic acid: with polyhydric alcohols, e.g. with 1,6-hexanediol, 1,9-nonanediol, ethylene glycol, 1,2-propanediol, neopentyl glycol, thiodiethylene glycol, diethylene glycol, Methylene glycol, pentaerythritol, tris (hydroxyethyl)isocyanurate, N,N'-bis(hydroxyethyl)oxalic acid diamide, 3-thiaundecanol, 3-thiapentadecanol, trimethylhexanediol, trimethylolpropane, 4-hydroxymethyl-1-phospha-2,6,7-trioxabicyclo[2.2.2]octane 1.14 Esters of β-(3,5-dicyclohexyl-4-hydroxyphenyl)propionic add: with mono- or polyhydric alcohols, e.g. with methanol, ethanol, octanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl)isocyanurate, N,N'-bis(hydroxyethyl)oxalic acid diamide, 3-thiaundecanol, 3-thiapentadecanol, trimethylhexanediol, trimethylolpropane, 4-hydroxymethyl-1-phospha-2,6,7-trioxabicyclo[2.2.2]-octane 1.15 Esters of 3,5-di-tert-butyl-4-hydroxyphenylacetic acid: with mono- or polyhydric alcohols, e.g. with methanol, ethanol, octanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl)isocyanurate, N,N'-bis(hydroxyethyl)oxalic acid diamide, 3-thiaundecanol, 3-thiapentadecanol, trimethylhexanediol, trimethylolpropane, 4-hydroxymethyl-1-phospha-2,6,7-trioxabicyclo[2,2,2]octane 1.16 Amides of β-(3,5-di-tert-butyl-4-hydroxyphenyl)propionic acid: N,N'-bis(3,5-di-tert-butyl-4-hydroxyphenylpropionyl)hexamethylenediamine, N,N'-bis(3,5di-tert-butyl-4-hydroxyphenylpropionyl)trimethylenediamine, N,N'-bis(3,5-di-tert-butyl-4-hydroxyphenylpropionyl) hydrazine 1.17 Ascorbic Acid (vitamin C)

1.18. Aminic antioxidants: N,N'-diisopropyl-p-phenylenediamine, N,N'-di-sec-butyl-p-phenylenediamine, N,N'-bis (1,4-dimethylpentyl)-p-phenylenediamine, N,N'-bis(1-ethyl-3-methylpentyl)-p-phenylenediamine, N,N'-bis(1-methylheptyl)-p-phenylenediamine, N,N'-dicyclohexyl-p-phenylenediamine, N,N'-diphenyl-p-phenylenediamine, N,N'-di(naphth-2-yl)-p-phenylenediamine, N-isopropyl-N'-phenyl-p-phenylenediamine, N-(1,3dimethylbutyl)-N'-phenyl-p-phenylenediamine, N-(1-methylheptyl)-N'-phenyl-p-phenylenediamine, N-cyclohexyl-N'-phenyl-p-phenylenediamine, 4-(p-toluenesulphonamido)-diphenylamine, N,N'-dimethyl-N,N'-di-sec-butyl-p-phenylenediamine, diphenylamine, N-allyldiphenylamine, 4-isopropoxydiphenylamine, 4-n-butylaminophenol, 4-butylaminophenol, 4-nonanoylaminophenol, 4-dodecanoylaminophenol, 4-octadecanoylaminophenol, di(4-methoxyphenyl)amine, 2,6-di-tert-butyl-4-dimethylaminomethyl phenol, 2,4'-diaminodiphenylmethane, 4,4'-diaminadiphenylmethane, N,N,N',N'-tetramethyl-2,4'-diaminodiphenylmethane, 1,2-dl[(2-methylphenyl)amino]-ethane, 1,2-di(phenylamino)propane, (o-tolyl)biguanide, dl[4-(1',3'-dimethylbutyl)phenyl]amine(tert-octylated N-phenyl-1-naphthylamine, mixture of mono- and di-alkylated tert-butyl/tert-octyl-diphenylamines, mixture of mono- and di-alkylated nonyldiphenylamines, mixture of mono- and di-alkylated dodecyldiphenylamines, mixture of mono- and di-alkylated isopropyl/isohexyl-diphenylamines, mixtures of mono- and di-alkylated tert-butyldiphenylamines, 2,3-dihydro-3,3-dimethyl-4H-1,4-benzathiazine, phenothiazine, mixture of mono- and di-alkylated tert-butyl/tert-octyl-phenothiazines, mixtures of mono- and dl-alkylated tert-octylphenothiazines, N-allylpheriothiazine, N,N,N',N'-tetraphenyl-1,4-diaminobut-2-ene, N,N-bis(2,2,6,6-tetramethylpiperidinyl)hexamethylenediamine, bis(2,2,6,6-tetramethylpiperidin-4-yl)sebacate, 2,2,6,6-tetramethylpiperidin-4-one, 2,2,6,6-tetramethylpiperidin-4-ol 2. Further Antioxidants 2.1 Aliphatic or aromatic phosphites, esters of thiodipropionic acid or thiodiacetic acid or salts of dithiocarbamic acid, 2,2,12,12-tetramethyl-5,9-dihydroxy-3,7,11-trithiatridecane and 2,2,15,15-tetramethyl-5,12-dihydroxy-3,7,10,14-tetrathiahexadecane 2.2 Sulphur-containing heterocyclic compounds: 2-mercaptobenzothiazole. 2,5-dimercapto-7,3,4-thiadiazole, 2,5-dimercaptobenzothiadiazole and derivatives thereof; 3,5-bis[di(2-ethylhexyl)aminomethyl]-1,3,4-thiadiazolin-2-one 2.3 Amino compounds: salicylidene-propylenediamine, salicylaminoguanidine and salts thereof.

3. Corrosion Inhibitors 3.1 Organic acids, their esters, metal salts, amine salts and anhydrides: alkyl- and alkenyl-succinic acids and their partial esters with alcohols, diols or hydroxycarboxylic acids, partial amides of alkyl- and alkenyl-succinic adds, 4-nonylphenoxyacetic acid, alkoxy- and alkoxyethoxy-carboxylic acids, such as dodecyloxyacetic acid, dodecyloxy(ethoxy)acetic acid and amine salts thereof, and also N-oleoyl-sarcosine, sorbitan monooleate, lead naphthenate, alkenylsuccinic acid anhydrides, e.g. dodecenylsuccinic acid anhydride, 2-(2-carboxyethyl)-1-dodecyl-3-methylglycerol and salts thereof, especially sodium and triethanolamine salts thereof.

3.2 Nitrogen-containing compounds:

3.2.1 Tertiary aliphatic or cycloaliphatic amines and amine salts of organic and inorganic adds, e.g. oil-soluble alkylammonium carboxylates, and 1-[N,N-bis(2-hydroxyethyl)amino]-3-(4-nonylphenoxy)propan-2-ol 3.2.2 Heterocyclic compounds: substituted imidazolines and oxazolines, e.g. 2-heptadecenyl-1-(2-hydroxyethyl)-imidazoline 3.2.3 Sulphur-containing compounds: barium dinonylnaphthalene sulphonates, calcium petroleum sulphonates, alkylthio-substituted aliphatic carboxylic acids, esters of aliphatic 2-sulphocarboxylic acids and salts thereof.

4. Viscosity Index-Increasers

Polyacrylates, polymethacrylates, vinylpyrrolidone/methacrylate copolymers, polyvinylpyrrolidones, polybutenes, olefin copolymers, styrene/acrylate copolymers, polyethers 5. Pour point Depressants Poly(meth)acrylates, ethylene/vinyl acetate copolymers, alkylpolystyrenes, fumarate copolymers, alkylated naphthalene derivatives 6. Dispersants/Surfactants Succinic acid amides or imides, polybutenylphosphonic acid derivatives, basic magnesium, calcium and barium sulphonates and phenolates 7. Extreme-Pressure and Anti-Wear Additives Sulphur- and halogen-containing compounds, e.g. chlorinated paraffins, sulphurated olefins or vegetable oils (soybean oil, rape oil), alkyl- or aryl-di- or -tri-sulphides, benzotriazoles or derivatives thereof, such as bis(2-ethylhexyl)aminomethyl tolutriazoles, dithiocarbamates, such as methylene-bis-dibutyldithiocarbamate, derivatives of 2-mercaptobenzothiazole, such as 1-[N,N-bis(2-ethylhexyl)aminomethyl]-2-mercapto-1H-1,3-benzothiazole, derivatives of 2,5-dimercapto-1,3,4-thiadiazole, such as 2,5-bis(tert-nonyldithio)-1,3,4-thiadiazole 8. Examples of Coefficient of Friction Reducers Lard oil, oleic add, tallow, rape oil, sulphurated fats, amides, amines. Further examples are given in EP-A-0 565 487.

9. Special Additives

Emulsifiers: petroleum sulphonates, amines, such as polyoxyethylated fatty amines, non-ionic surface-active substances; buffers: such as alkanolamines; biocides: triazines, thiazolinones, tris-nitromethane, morpholine, sodium pyridenethiol; processing speed improvers: calcium and barium sulphonates.

An example of a mixture of additional additives to be added as Component C) is given below:

| Additive | Mass % Broad Range | Mass % Preferred Range |
|---|---|---|
| Ashless Dispersant | 0.1-20.0 | 1.0-8.0 |
| Metal Detergents | 0.1-15.0 | 0.2-9.0 |
| Corrosion Inhibitor | 0.0-5.0 | 0.0-1.5 |
| Metal dihydrocarbyl dithiophosphate | 0.1-6.0 | 0.1-4.0 |
| Supplemental Anti-oxidant | 0.0-5.0 | 0.01-1.5 |
| Pour Point Depressant | 0.01-5.0 | 0.01-1.5 |
| Anti-Foaming Agent | 0.0-5.0 | 0.001-0.15 |
| Supplemental Anti-wear Agents | 0.0-0.5 | 0.0-0.2 |
| Friction Modifier | 0.0-5.0 | 0.0-1.5 |
| Viscosity Modifier | 0.01-6.0 | 0.0-4.0 |
| Synthetic and/or Mineral Oil Base | Balance | Balance |

The above-mentioned additives may be admixed with the above-mentioned components A) and B) in a manner known per se. It is also possible to prepare a concentrate or a so-called "additive pack", which can be diluted to give the working concentrations for the intended lubricant. In a preferred embodiment, components A), B) and C) are liquid at room temperature in the concentrate. The concentrate may further be diluted by the addition of the base oil according to Component D).

Component D

A low sulphur oil of lubricating viscosity can be used for the preparation of combustion engine oils. The total sulphur content in the low sulphur oil should not exceed the limit of more than 0.3 weight % with regard to the total weight of the composition.

Suitable combustion engine oils are based, for example, on mineral oils, natural oils, synthetic oils or mixtures thereof. These oils are known and familiar to the person skilled in the art and are described in standard reference books, such as in *Chemistry and technology of Lubricants*; Mortier, R. M. and Orszulik, S. T. (Editors); 1992 Blackie and Son Ltd. for GB, VCH-Publishers N.Y. for U.S., ISBN 0-216-92921-0, pages 208 et seq. and 269 et seq.; In Kirk-Othmer *Encyclopedia of Chemical Technology, Fourth Edition* 1969, J. Wiley & Sons, New York, Vol. 13, page 533 et seq. (Hydraulic Fluids); Performance Testing of Hydraulic Fluids; R. Tourretand E. P. Wright, Hyden & Son Ltd. GB, on behalf of The Institute of Petroleum London, ISBN 0 85501 317 6; Ullmann's Encyclopedia of Ind. Chem., Fifth Completely Revised Edition, Verlag Chemie, DE-Weinheim, VCH-Publishers for U.S., Vol. A 15, page 423 et seq. (lubricants), Vol. A 13, page 165 et seq. (hydraulic fluids).

The base oil of lubricating viscosity is preferably a mineral oil derived lubricating base oil containing 80% by mass or more of a saturated hydrocarbon component. Various methods for producing the mineral oil derived lubricating base oil are available. For example, the lubricating base oil may be a paraffin oil or a naphthenic oil obtainable by subjecting a lubricating oil fraction derived from an atmospheric or vacuum distillation of crude oil to refining processes, such as deasphalting, solvent refining, such as solvent extraction with furfural, hydrocracking, solvent or catalytic dewaxing, such as solvent or catalytic dewaxing, hydrotreating, such as hydrocracking or hydrofinishing, clay treatment, such as washing with acid treated or activated clay, or chemical refining, such as washing with caustic soda or sulphuric acid and the like. Combinations of these methods are also available for producing the mineral oil derived lubricating base oil.

Preferred methods for producing the mineral oil derived lubricating base oil consists of the following technical procedures, wherein one of the following oils is used as feedstock oil:

1) A distillate derived from the atmospheric distillation of a paraffin crude oil and/or a mixed crude oil;
2) A whole vacuum gas oil (WVGO) of a paraffin crude oil and/or a mixed crude oil:
3) An oil obtained by subjecting the product obtained according to 1) and/or 2) to mild hydrocracking (MHC);
4) A mixture of two or more selected from products obtained according to 1) to 3);
5) A deasphalted oil (DAO) from products obtained according to 1), 2), 3) or 4);
6) An oil obtained by subjecting the product obtained according to 5) to mild hydrocracking; and
7) A mixture of two or more oils selected from the group of oils obtained according to 1) through 6).

Either the feedstock oil itself or a lubricating oil fraction recovered there from is refined by conventional refining processes, such as the ones mentioned above, to obtain a lubricating oil fraction which is useful as the component a) of the claimed composition. The base oil may be present in the composition as an individual component or in a combination of two or more of the above-mentioned base oils.

Base oils obtained from gaseous feedstocks by Hie so-called gas to liquid process (GTL oils) or any other process can be used as the major or minor component of the claimed lubricants.

Other base oils of lubricating viscosity can be used, for example oils based on vegetable and animal oils, fats, tallow, wax and mixtures thereof. Vegetable and animal oils, fats, tallow and wax are, for example, palm-kernel oil, palm oil, olive oil, rapeseed oil, rape oil, linseed oil, soybean oil, cottonseed oil, sunflower oil, coconut oil, maize oil, castor oil, low-grade olive oil and mixtures thereof, fish oils, and also the chemically modified, for example epoxidised and sulphoxidised, forms thereof, or forms thereof produced by genetic engineering, for example genetically engineered soybean oil.

Examples of synthetic oils include lubricants based on aliphatic or aromatic carboxy esters, polymeric esters, polyalkylene oxides, phosphoric acid esters, poly-α-olefins or silicones, the diester of a divalent acid with a monohydric alcohol, such as, for example, dioctyl sebacate or dinonyl adipate, a triester of trimethylolpropane with a monovalent acid or with a mixture of such acids, such as, for example, trimethylolpropane tripelargonate, trimethylolpropane tricaprylate or mixtures thereof, a tetra ester of pentaerythritol with a monovalent acid or with a mixture of such acids, such as pentaerythritol tetracaprylate, or a complex ester of monovalent and divalent acids with polyhydric alcohols, for example a complex ester of trimethylolpropane with caprylic and sebacic acid, or a mixture thereof. Apart from mineral oils, poly-α-olefins, ester-based lubricants, phosphates, glycols, polyglycols and polyalkylene glycols, and also mixtures thereof with water are especially suitable.

An organic or Inorganic thickener (base fat) may also be added to the above-mentioned lubricants or mixtures thereof.

A further embodiment of the invention relates to an additive composition, which comprises A) An additive mixture that essentially consists of
  a) At least one ammonium phosphate ester;
  b) At least one thiophosphoric acid ester, and
  c) At least one dithiophosphoric acid derivative; and B) Sulphur containing oil additives.

The additive composition is prepared by conventional mixing techniques. The compositions according to the invention preferably comprise 0.01 to 5.0% by weight, in particular 0.02 to 1.0% by weight, of the additive composition of above comprising the components A) and B), based on the weight of the base oil component D).

A further embodiment of the invention relates to the additive mixture that essentially consists of a) At least one ammonium phosphate ester;
b) At least one triphosphoric acid ester; and
c) At least one dithiophosphoric acid derivative For use in combustion engines, particularly spark-ignition or Diesel motor engines.

A further embodiment of the invention relates to process for the reduction of wear in combustion engines, which comprises adding to the engine the lubricant composition as defined above, wherein the total amount of sulphur in that composition is less than 0.3%, particularly 0.2%, by weight and that of phosphorus less than 0.08% by weight.

The following Examples illustrate the Invention.

APPLICATION EXAMPLES

Test matrix: Anti-wear activity. The target is to show that the Zn-free compositions according to the invention have the same protection against wear as corresponding compositions comprising Zn-dithiophosphate.

TABLE 1

(Compositions Tested)

| Components [weight %] | Ex. 1 | Ex. 2 | Ex. 3 | Ex. 4 | Ex. 5 | Target |
|---|---|---|---|---|---|---|
| Base oil[1)] | 100 | 98.8 | 99.9 | 98.65 | 98.8 | |
| O,O,O-tris(2(or4)-C9-10-isoalkylphenyl)phosphorothioate | | | | | 0.20 | |
| 3-[[bis(2-methylpropoxy)phosphinothioyl]thio]-2-methylpropanoic acid | | | | 0.25 | 0.40 | |
| O,O-diisopropyl hydrogen dithiophosphate alkyl amine | | | | 0.50 | | |
| Amines, C11-14-branched alkyl, monohexyl and Dihexyl phosphates | | | — | 0.50 | 0.50 | |
| C9-alkyldithiothiadiazole | | | 0.10 | 0.10 | 0.10 | |
| ZnDTP | | 1.2 | | | | |
| Viscosity 40° C. [$mm^2/s$] | 81.20 | 86.80 | 79.90 | 81.00 | 81.60 | |
| Content P [ppm] | 0 | 993 | 0 | 760 | 730 | <800 |

[1)]Group III oil PAO (poly-alpha-olefin) + customary oil additives

TABLE 2

(Results)

| C&T P-VW 5106[1)] | Ex. 1 | Ex. 2 | Ex. 3 | Ex. 4 | Ex. 5 | Target |
|---|---|---|---|---|---|---|
| Cam | | | | | | |
| Wear average [μ] | 1584 | 101 | 723 | 120 | 59 | ≦75 |
| Pitting average [μ] | | 11.4 | | 11.1 | 10.1 | ≦20 |
| Tappet | | | | | | |
| Wear average [μ] | | 83.3 | | 53 | 50 | ≦100 |
| Pitting average [μ] | | 8.3 | | 18.6 | 10.0 | ≦20 |

[1)]VW-test; published by ISP GmbH, Neuenkirchener Str. 7, D-48499 Salzbergen, Germany

TABLE 3

(Compositions Tested)

| Components [weight %] | Ex. 6 | Ex. 7 | Ex. 6 | Ex. 9 |
|---|---|---|---|---|
| Base oil[1)] | 99.5 | 99.15 | 98.45 | 98.0 |
| O,O,O-tris(2(or4)-C9-10-iso-alkylphenyl)phosphorothioate | | | 0.20 | 0.20 |
| 3-[[bis(2-methylpropoxy)phosphinothioyl]thio]-2-methylpropanoic acid | | 0.25 | 0.25 | 0.20 |
| O,O-diisopropyl hydrogen dithiophosphate alkyl amine | | | 0.50 | 1.00 |
| Amines, C11-14-branched alkyl, monohexyl and Dihexyl phosphates | | 0.50 | 0.50 | 0.50 |
| C9-alkyldithiothiadiazole | | 0.10 | 0.10 | 0.10 |
| ZnDTP | 0.045 | | | |
| P-calculated [ppm] | 450 | 472 | 732 | 992 |

[1)]Group III oil PAO (poly-alpha-olefin) + customary oil additives

TABLE 4

(Results)

| PDSC IL 85[1)] | Ex. 6 | Ex. 7 | Ex. 8 | Ex. 9 | Target |
|---|---|---|---|---|---|
| Oxidation induction time [min] | 110 | 135 | 150 | 145 | >80 |
| VIT[2)] [hours] | 40 | 65 | 70 | 45 | >40 |
| P-losses [ppm] | | | | | |
| initial | 456 | 490 | 855 | 984 | |
| after 48 h at 160° C. | 451 | 461 | 760 | 986 | |

[1)]Assessment of oxidation stability by Pressurized Differential Scanning Calorimetry (PDSC) according to ACEA specifications for engine oils 2004, pg. 13, row 1.11 (www.ace-a.be)
[2)]Bulk oil oxidation, time to 375 viscosity increase

TABLE 5

(OM611* Test Results)

| | Ex. 10 | Ex. 11 | DB 228.5 Limit |
|---|---|---|---|
| Kinematic viscosity at 100° C. [$mm^2$/sec] | 14.3 | 13.2 | — |
| Camshaft intake wear [μm] | 155 | 91 | 120 max. |
| Camshaft exhaust wear [μm] | 208 | 134 | 140 max. |
| Cylinder liner wear [μm] | 2.3 | 2.1 | 5.2 max. |
| Fresh oil [P content in ppm] | 647 | 701 | — |
| Oil at end of test [P content in ppm] | 680 | 770 | — |

TABLE 5-continued (OM611* Test Results)

| | Ex. 10 | Ex. 11 | DB 228.5 Limit |
|---|---|---|---|
| Oil at end of test [Fe content in ppm] | 740 | 701 | — |
| Oil at end of test [Cu content in ppm] | 23 | 30 | — |

Comments:
Example Nos. 10 and 11 are two engine oil tests formulated with phosphorothioate, dithiophosphate alkyl amine, amines monohexyl and dihexyl phosphates and thiadiazoles, as shown in Table 3 with approximately equimolar quantities of each type of phosphorus. However, Example 10 has only 170 ppm P from dithiophosphate. Example 11 has 250 ppm P from dithiophosphate. The oils are tested in the OM 611 Diesel engine.

This test measures camshaft wear at intake and exhaust positions as well as cylinder liner Wear, among several other parameters. The OM611 is considered by the European lubricant industry to be the best replacement for the OM602A wear test.

The invention claimed is:

1. A lubricant composition for use in combustion engines comprising

A) An additive mixture that essentially consists of a) At least one O,O-diisopropyl hydrogen dithiophosphate alkyl amine or compound comprising a phosphate and an amine complexed together and having the chemical structure:

wherein said phosphate of said compound comprises a combination of monohexyl phosphate and a dihexyl phosphate and Ra and Rb are each independently a C11-14-branched alkyl group;

b) At least one thiophosphoric acid ester comprising an O,O,O-tris(2(or 4)-C9-10-iso-alkyphenyl)phosphorothioate; and c) At least one dithiophosphoric acid derivative comprising 3-[[bis(2-methylpropoxy)phosphinothioyl]thio]-2-methylpropanoic acid, wherein a) is present in said additive mixture (A) in an amount of from about 45 to about 79 part by weight per 100 part by weight a), b) and c), wherein b) is present in said additive mixture (A) in an amount of form about 10 to about 18 parts by weight per 100 parts by weight of a), b) and c), and wherein c) is present in said additive mixture (A) is an amount of from about 10 to about 36 parts by weight per 100 parts by weight of a), b) and c), B) At least on sulphur containing oil additive;

C) Customary crank case oil additives; and

D) Low sulphur oil of lubricating viscosity;

with the proviso that the total amount of sulphur in the composition is less than 0.3 weight %.

2. A lubricant composition according to claim 1, wherein the sulphur containing oil additive B) is a dithioglycidyl ether selected from the group consisting of

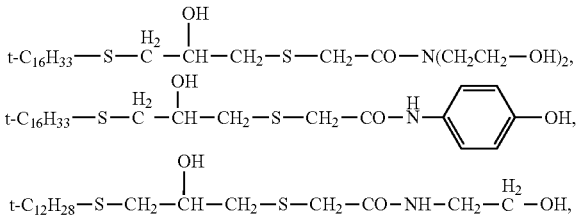

-continued

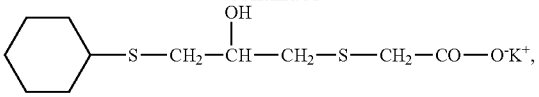

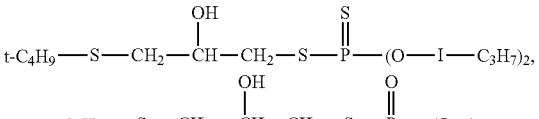

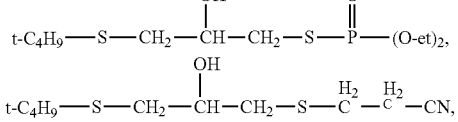

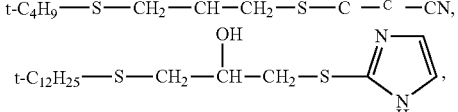

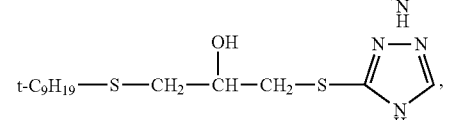

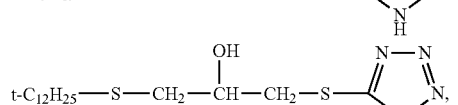

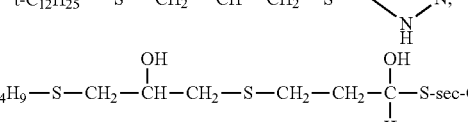

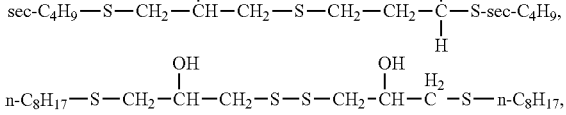

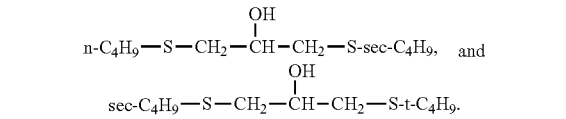

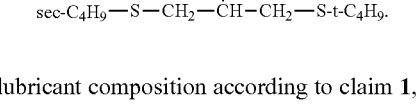

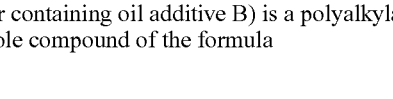

3. A lubricant composition according to claim 1, wherein the sulphur containing oil additive B) is a polyalkylated 1,3, 4-thiadiazole compound of the formula

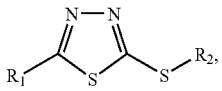

Wherein $R_1$ represents hydroxy, amino, mercapto, alkylthio, 2-hydroxyalkylthio or the $R_2$—S group and $R_2$ represents a polyolefin residue represented by the partial formulae:

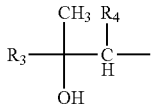

or isomeric

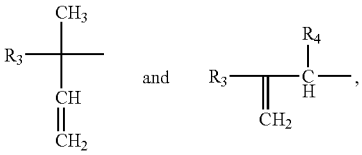

wherein $R_3$ represents alkyl having 50 to 400 carbon atoms and $R_4$ represents hydrogen or methyl.

4. A lubricant composition according to claim 1, wherein the low sulphur oil of lubricating viscosity D) is a mineral oil, synthetic oil, natural oil or a mixture thereof.

5. A lubricant composition according to claim 1, wherein the total amount of sulphur in the composition is less than 0.2% by weight.

6. A process for the reduction of wear in combustion engines, which comprises adding to the engine the lubricant composition according to claim 1, wherein the total amount of sulphur in that composition is less than 0.3% by weight and that of phosphorus less than 0.08% by weight.

7. A lubricant composition as set forth in claim 1 wherein said A) additive mixture consists essentially of said O,O-diisopropyl hydrogen dithiophosphate alkyl amine, b) and c).

8. A lubricant composition as set forth in claim 1 wherein said A) additive mixture consists essentially of said compound comprising the phosphate and the amine complexed together, b) and c).

9. A lubricant composition as set forth in claim 1 that produces a wear average of less than or equal to 75 μm and a pitting average of less than or equal to 20 μm on a cam when measured according to C&T P-VW 5106.

10. A lubricant composition as set forth in claim 9 that produces a wear average of less than or equal to 100 μm and a pitting average of less than or equal to 20 μm on a tappet when measured according to C&T P-VW 5106.

11. A lubricant composition as set forth in claim 1 that produces a wear average of less than or equal to 100 μm and a pitting average of less than or equal to 20 μm on a tappet when measured according to C&T P-VW 5106.

12. A lubricant composition as set forth in claim 1 that has an oxidation induction time of greater than 80 minutes when measured according to PDSC IL 85.

13. A lubricant composition as set forth in claim 1 that produces a wear average of less than or equal to 75 μm and a pitting average of less than or equal to 20 μm on a cam when measured according to C&T P-VW 5106, that produces a wear average of less than or equal to 100 μm and a pitting average of less than or equal to 20 μm on a tappet when measured according to C&T P-VW 5106, and that has an oxidation induction time of greater than 80 minutes when measured according to PDSC IL 85.

14. A lubricant composition as set forth in claim 1 wherein said a) O,O-diisopropyl hydrogen dithiophosphate alkyl amine is present in said lubricant composition in an amount of up to 5.0 weight percent based on a total weight percent of said composition.

15. A lubricant composition as set forth in claim 1 wherein said a) O,O-diisopropyl hydrogen dithiophosphate alkyl amine is present in said lubricant composition in an amount of up to 1.0 weight percent based on a total weight percent of said composition.

16. A lubricant composition as set forth in claim 1 wherein said a) compound comprising said phosphate and said amine complexed together is present in said lubricant composition in an amount of up to 5.0 weight percent based on a total weight percent of said composition.

17. A lubricant composition as set forth in claim 1 wherein said a) compound comprising said phosphate and said amine complexed together is present in said lubricant composition in an amount of up to 1.0 weight percent based on a total weight percent of said composition.

18. A lubricant composition as set forth in claim 1 wherein said b) at least one thiophosphoric acid ester comprising said O,O,O-tris(2(or 4)-C9-10-iso-alkylphenyl) phosphorothioate is present in said lubricant composition in an amount of up to 2.0 weight percent based on a total weight of said composition.

19. A lubricant composition as set forth in claim 1 wherein said b) at least one thiophosphoric acid ester comprising said O,O,O-tris(2(or 4)-C9-10-iso-alkylphenyl) phosphorothioate is present in said lubricant composition in an amount of up to 0.20 weight percent based on a total weight of said composition.

20. A lubricant composition as set forth in claim 1 wherein said c) at least one dithiophosphoric acid derivative comprising 3[[bis(2-methylpropoxy)phosphinothioyl]thio]-2- methylpropanoic acid is present in said lubricant composition in an amount of up to 2.0 weight percent based on a total weight of said composition.

21. A lubricant composition as set forth in claim 1 wherein said c) at least one dithiophosphoric acid derivative comprising 3-[[bis(2-methylpropoxy)phosphinothioyl]thio]-2-methylpropanoic acid is present in said lubricant composition in an amount of up to 0.40 weight percent based on a total weight of said composition.

22. A lubricant composition as set forth in claim 1 wherein said a) O,O-diisopropyl hydrogen dithiophosphate alkyl amine is present in said lubricant composition in an amount of up to 1.0 weight percent based on a total weight percent of said composition, said a) compound comprising said phosphate and said amine complexed together is present in said lubricant composition in an amount of up to 1.0 weight percent based on a total weight percent of said composition, said b) at least one thiophosphoric acid ester comprising said O,O,O-tris(2(or 4)-C9-10-iso-alkylphenyl)phosphorothioate is present in said lubricant composition in an amount of up to 0.2 weight percent based on a total weight of said composition, and said c) at least one dithiophosphoric acid derivative comprising 3-[[bis(2-methylpropoxy)phosphinothioyl]thio] 2- methylpropanoic acid is present in said lubricant composition in an amount of up to 0.40 weight percent based on a total weight of said composition.

* * * * *

UNITED STATES PATENT AND TRADEMARK OFFICE

CERTIFICATE OF CORRECTION

PATENT NO. : 8,404,624 B2
APPLICATION NO. : 11/886701
DATED : March 26, 2013
INVENTOR(S) : Marc Ribeaud It is certified that error appears in the above-identified patent and that said Letters Patent is hereby corrected as shown below:

IN THE CLAIMS:

Column 18, line 28, insert the following structure after the phase in line 27, which reads "the chemical structure:"

-- 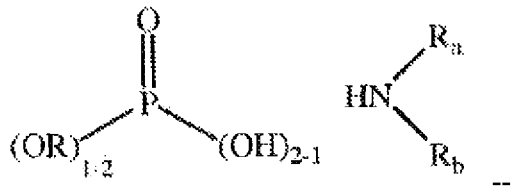 --

Column 18, line 42, delete "part" before "by weight" and replace with -- parts --

Column 18, line 45, please delete "is" before "an amount of" and replace with -- in --

Signed and Sealed this
Seventeenth Day of June, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,404,624 B2
APPLICATION NO. : 11/886701
DATED : March 26, 2013
INVENTOR(S) : Ribeaud It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 569 days.

Signed and Sealed this
Thirtieth Day of September, 2014

Michelle K. Lee

Michelle K. Lee
*Deputy Director of the United States Patent and Trademark Office*